US005165820A

United States Patent [19]

Bunk et al.

[11] Patent Number: 5,165,820

[45] Date of Patent: Nov. 24, 1992

[54] COMPACTION PLANK FOR A ROAD FINISHING MACHINE

[75] Inventors: Klaus-Dieter Bunk, Grossenkneten; Anton Fricke, Barsselermoor; Manfred Kurtz, Wardenburg; Ernst Matten, Werlte, all of Fed. Rep. of Germany

[73] Assignee: Dynapac GmbH, Wardenburg, Fed. Rep. of Germany

[21] Appl. No.: 566,369

[22] PCT Filed: Oct. 25, 1989

[86] PCT No.: PCT/DE89/00682

§ 371 Date: Sep. 5, 1990

§ 102(e) Date: Sep. 5, 1990

[87] PCT Pub. No.: WO90/07030

PCT Pub. Date: Jun. 28, 1990

[30] Foreign Application Priority Data

Dec. 19, 1988 [DE] Fed. Rep. of Germany ..... 3842706
Oct. 10, 1989 [DE] Fed. Rep. of Germany ..... 3933742

[51] Int. Cl.[5] ..... E01C 19/38
[52] U.S. Cl. ..... 404/102
[58] Field of Search ..... 404/102, 83-86

[56] References Cited

U.S. PATENT DOCUMENTS 1,644,511 10/1927 Carr .
3,252,390 5/1966 Martinson ..... 404/102
3,504,598 4/1970 Haker ..... 404/102 X
3,508,475 4/1970 Smith ..... 404/102
3,541,932 11/1970 Hodson ..... 404/102
3,856,425 12/1974 Miller et al. ..... 404/84
4,828,428 5/1989 Anderson ..... 404/102

FOREIGN PATENT DOCUMENTS 2147691 9/1971 Fed. Rep. of Germany .
3127377 7/1981 Fed. Rep. of Germany .
3209989 3/1982 Fed. Rep. of Germany .
3500277 1/1985 Fed. Rep. of Germany .

*Primary Examiner*—Ramon S. Britts
*Assistant Examiner*—Nancy P. Connolly
*Attorney, Agent, or Firm*—Collard & Roe

[57] ABSTRACT

Compaction plank for a road-finishing machine for incorporating and compacting freshly laid roadmaking material (3), preferably having a variable effective width. To this end, the compaction plank preferably comprises a main plank and laterally extendable adjusting planks. It also has a base plate (2, 18) for flattening the roadmaking material (3) associated with one or more bar-shaped, driven stampers (5, 6). Two stampers (5, 6) are provided, namely a front stamper (5) arranged in front of the base plate (2, 18) in the direction of travel (4) of the road-finishing machine and a rear stamper (6) arranged between the elements of the base plate (2, 18). The stampers (5, 6) are preferably interconnected by a two-armed lever (7), each stamper (5, 6) being connected with one of the two lever arms (*7a, 7b*), and the lever (7) can be driven so as to oscillate about its bearing point (8).

23 Claims, 5 Drawing Sheets

COMPACTION PLANK FOR A ROAD FINISHING MACHINE

Figure 1:
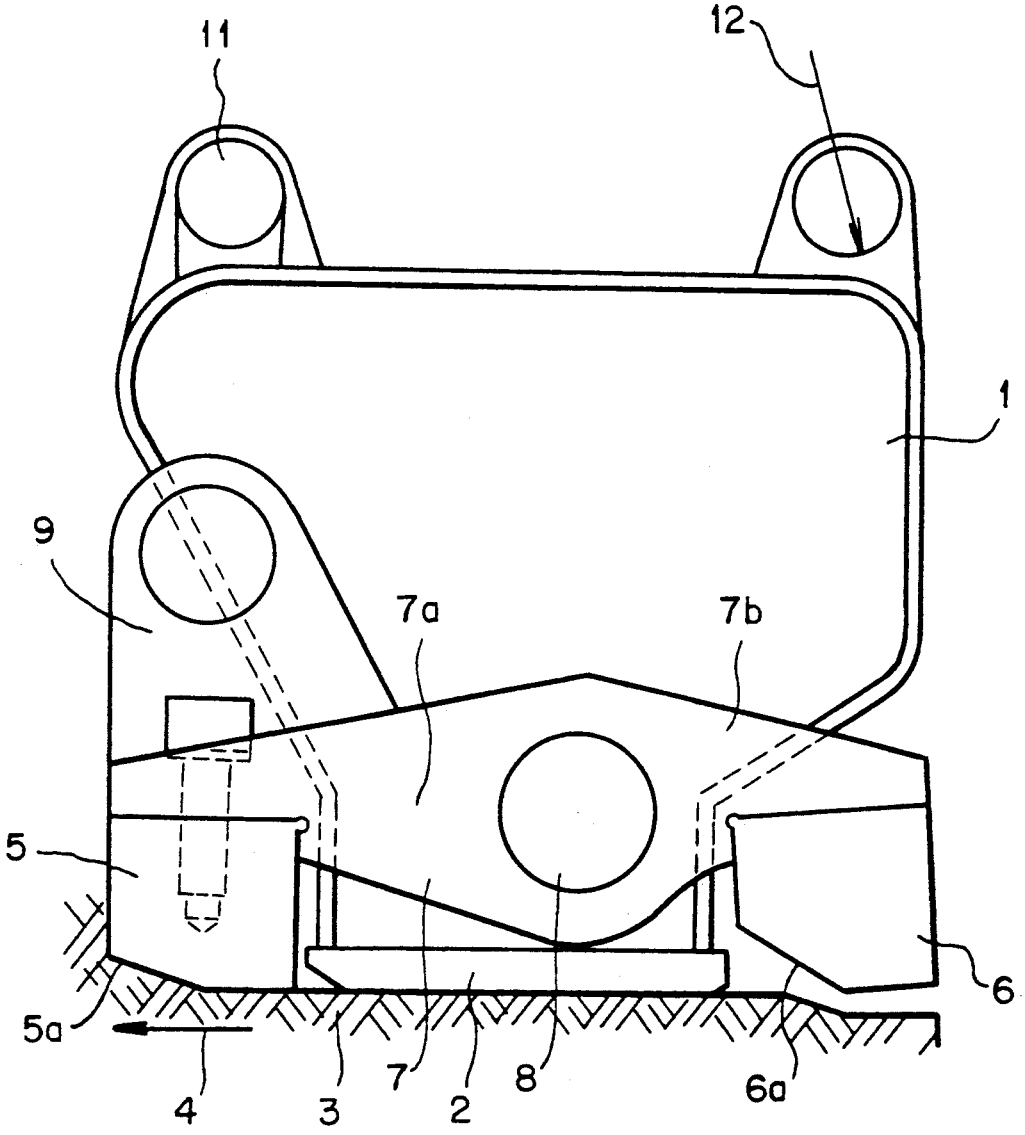

The invention relates to a compaction plank for a road finishing machine, for installation and compaction of freshly laid road surface material, which preferably can be adjusted in its working width, and for this purpose preferably demonstrates a main plank and adjustable planks which can be extended laterally, and which has a base plate which acts in the plane of the road surface material, to which one or more, preferably strip-shaped, powerdriven rammers are assigned.

Road finishing machines with compaction planks of the type stated are commercially available. The base plate compresses the freshly laid road surface material. It is supported in this by the rammer(s). Often, there are two rammers, mostly in the shape of strips or blades, so that they exert a greater area pressure on the road surface material than the base plate. The aim is to achieve the best possible compaction of the laid road surface material, so that subsequent collapse or sinking of the road surface material when traffic drives over it is prevented, if possible. A high level of compaction is also supposed to be achieved with conventional compaction planks with the combination of rammers and base plate. However, when using rammers and a base plate, the problem can occur that the base place with vibration drive and the rammer(s) with oscillation drive counteract one another instead of supporting one another, i.e. what can happen is that the road surface material which was compacted by the base plate is loosened again by the rammers, instead of being further compacted, or vice versa.

In order to achieve the best possible compaction of the road surface material, it is therefore very important to coordinate the work methods of the base plate and the rammer(s), and not only to coordinate the rammers with the base plate, but also the rammers with each other. For example, what can happen if this is not done is that with a combined use of two rammers arranged next to one another, a type of suction effect can occur instead of a compaction effect, and that in this way, the fine and liquid components of the road surface material, in particular, are suctioned up instead of being compacted. It is also possible that the road surface material which has already been compacted is shaken loose again.

The invention is based on the task of improving a compaction plank for a road finishing machine, of the type stated initially, in such a way that better compaction of the road surface material is achieved.

This task has been accomplished, according to the invention, in that at least two rammers are provided, one of which is arranged in front of the base plate in the direction of travel of the road finishing machine, as a preparatory rammer, and the other of which is arranged in the middle of the base plate, as a post-compaction rammer.

With this arrangement of the rammers and the base plate, the rammers and the segments of the base plate, especially the front base plate segment, work together more effectively, without one of these elements cancelling out the compaction work of another of these elements.

Even better compaction is achieved if the rammers are driven in opposite cycles, as provided by a further development of the invention.

The expenditure and design effort for construction of the compaction plank according to the invention are kept relatively low if the rammers are coupled together in terms of drive, since a second drive is not necessary then, and coordination of the two rammers is possible in simple manner, by designing them accordingly.

Preferably, the rammers are connected with one another via a two-arm lever, with each of the rammers being connected with one of the two lever arms, and the lever being driven to pivot around its fulcrum.

In a preferred embodiment of the compaction plank according to the invention, the rammers exert different ramming forces. This is preferably accomplished by the fact that the lever arms of the lever which attach to the rammers are of different lengths, with the lever arm of the lever which attaches to the post-compaction rammer preferably being the shorter one.

The invention preferably makes use of the two-arm lever for attaching the rammer strips, because during operation, oscillation amplitude levels which are a function of the speed of rotation result due to the different lengths of the lever arms, and these are transmitted to the base place, especially the front base plate segment, as uniform vibrations, and therefore make it possible to avoid the undesirable effect of vibrations which accumulate or cancel each other out in uncontrolled manner, as in conventional designs, in that a separate vibration drive can be eliminated, at least for the front base plate segment.

Since different types of road surface material are supposed to be compacted in some circumstances, it is advantageous that the rammer stroke of the rammers is adjustable, according to a further development of the compaction plank. This also makes it possible to adjust the working method of the rammers to different thicknesses of road surface material.

Preferably, the ramming frequency of the rammers is adjustable.

To drive the rammers, the rammer drive can comprise a working cylinder, preferably a hydraulic cylinder, and an exciter for oscillating excitation of the piston. This exciter can be a type of impulse generator, for example. It is also possible, however, and preferably provided, that the rammer drive comprises a cam driven in rotation, which preferably acts on the lever or the rammers via a connecting rod. In this connection, it is certainly possible to replace the cam with a crank mechanism.

A change in the rammer stroke can be advantageously achieved, according to a further development of the invention, by the fact that the eccentricity of the cam of the rammer drive can be changed.

Another further development of the invention provides that a rear base plate segment which smooths the road surface material is arranged after the post-compaction rammer.

Particularly good post-compaction is achieved if the postcompaction rammer reaches down as far as the working surface of the rear base plate segment with its effective surface during the ramming movement.

According to a further development, for which independent protection is also being claimed, the compaction plank is characterized by the fact that the working surface of the front base plate segment is arranged higher than the working surface of the subsequent rear base plate segment, by the maximum rammer stroke of the post-compaction rammer. The post-compaction rammer therefore compacts the laid road surface material from the level of the working surface of the front base plate segment to the level of the working surface of the rear base plate segment.

Different layer thicknesses of road surface material can be taken into account according to a further development of the invention, for which independent protection is also being claimed, by the fact that the front base plate segment can be lowered, at least with one segment of its working surface, preferably to the level of the working surface of the rear base plate segment, in order to reduce the height difference to the rear base plate segment. By this lowering, the rammer stroke of the post-compaction rammer can indirectly be made ineffective, namely if the working surface of the front base plate segment is lowered to the same level as the working surface of the rear base plate segment, and the post compaction rammer no longer projects beyond both levels with its stroke.

A preferred embodiment of the compaction plank provides that for lowering, the front base plate segment is mounted to pivot around a pivot axis parallel to its longitudinal axis, which runs perpendicular to the direction of travel. The front base plate segment can therefore be adjusted in its angle and therefore can also be lowered, at least with one segment. The angle adjustment has the advantage, as compared with vertical lowering, that a better transition from the preparatory rammer to the level of the working surface of the rear base plate segment is achieved. The pivot axis around which the front base plate segment can be pivoted can also be an imaginary axis, which is determined only by pivot points, for example.

This pivoting of the front base plate segment is possible without also changing the position of the rammers, since the front base plate segment can be mounted separately for this pivoting.

In order to achieve metered adjustment, i.e. pivoting of the front base plate segment to the greatest extent possible, an adjustment device is provided, which can comprise a screw drive, for example. Of course, a stepper motor, an adjustment screw, spindle or similar device can also be provided.

Preferably, the radial distance of the front edge of the front base plate segment, pointing in the direction of travel of the road finishing machine, from the pivot axis is less than the distance of the rear edge of the front base plate segment, pointing in the direction of the rear base plate segment, so that the rear edge can be lowered, in order to be able to make the post-compaction rammer ineffective, if necessary, by changing the angle of the front base plate segment.

The rammers are preferably bevelled at their front edges, in other words at their edges pointing in the direction of travel with the bevels of the preparatory rammer and the post-compaction rammer demonstrating different angles relative to a horizontal plane in a preferred embodiment, for example 30° and 45°. Specifically, the bevel of the post-compaction rammer preferably forms the greater angle with a horizontal plane.

In addition, the rammers can also be bevelled at their rear edges, with these bevels preferably being less marked than the front bevels.

Refitting conventional road finishing machines with the compaction plank according to the invention, and replacement of the compaction plank are simplified, according to a further development of the invention, by the fact that the front base plate segment and the rammers are brought together in an interchangeable unit.

Figure 2:
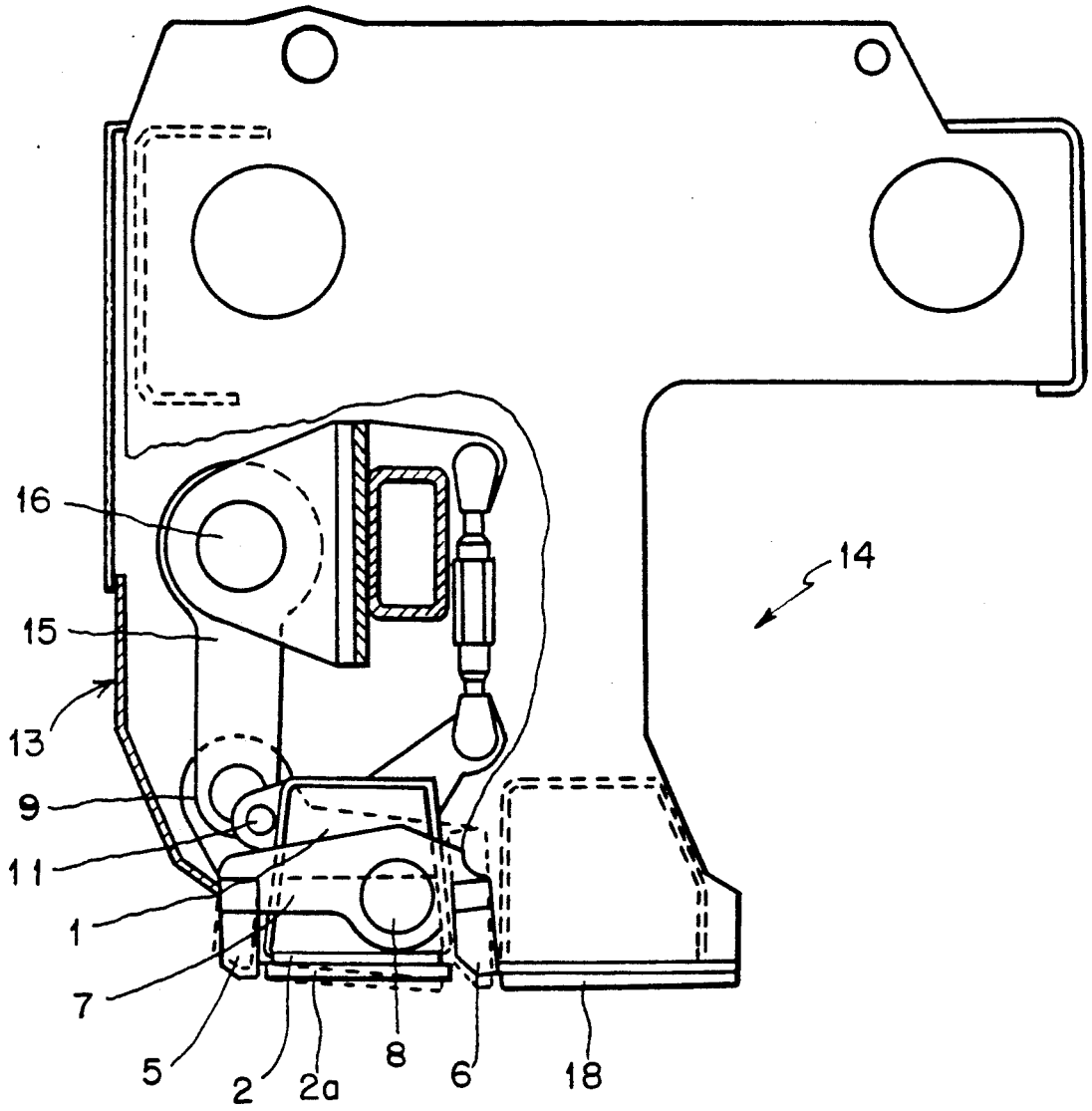
Figure 3:
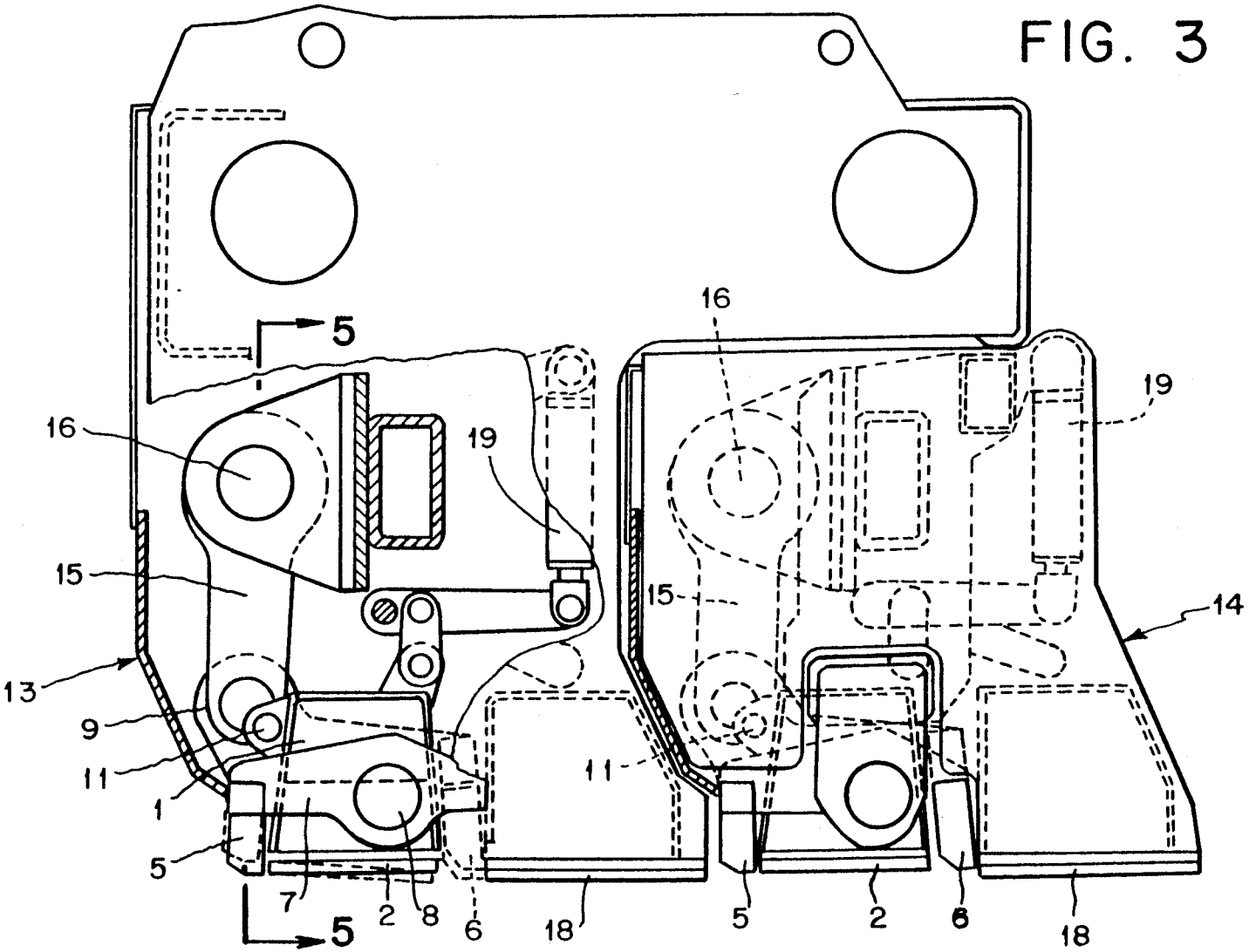
Figure 4:
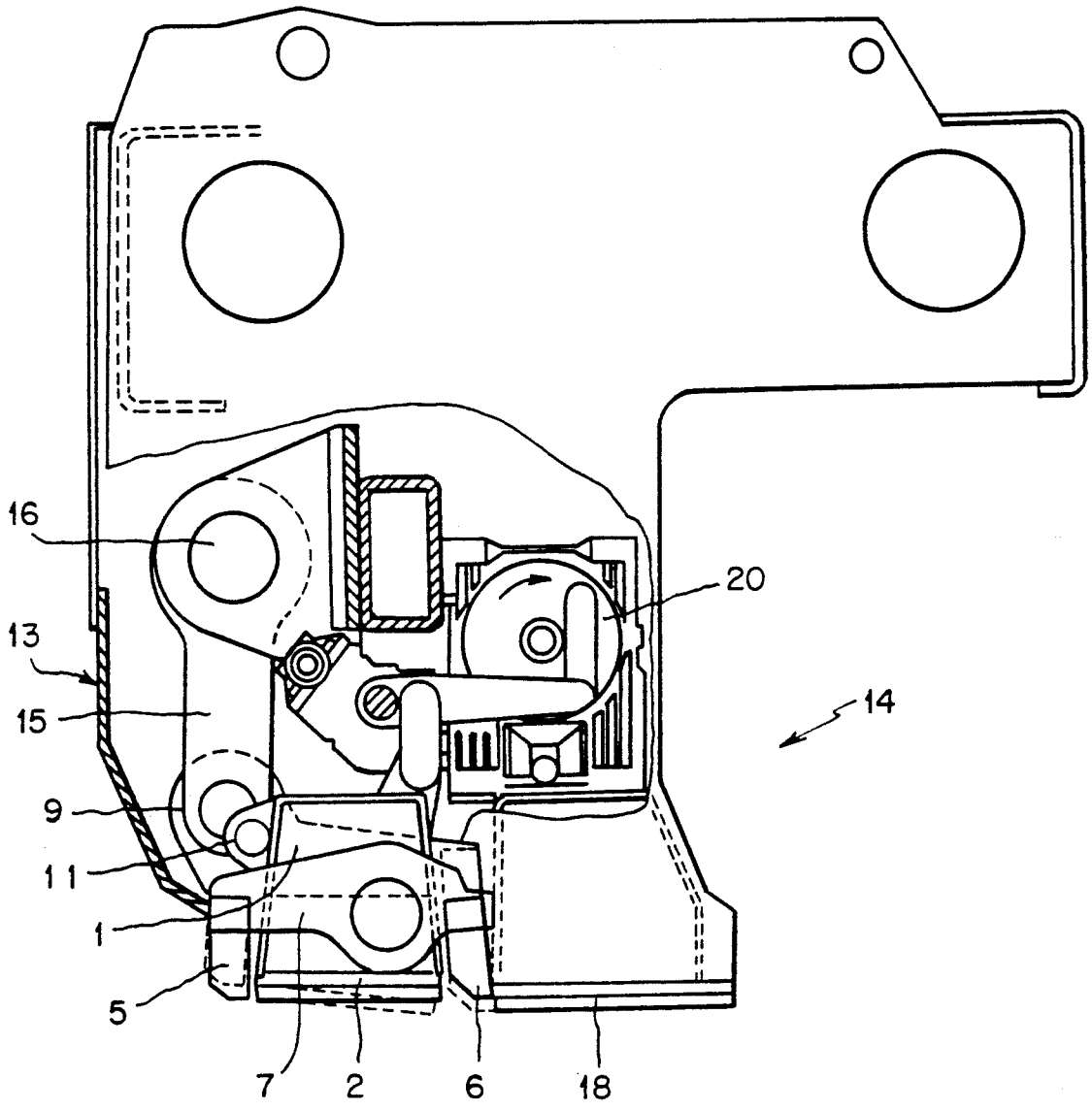
Figure 5:
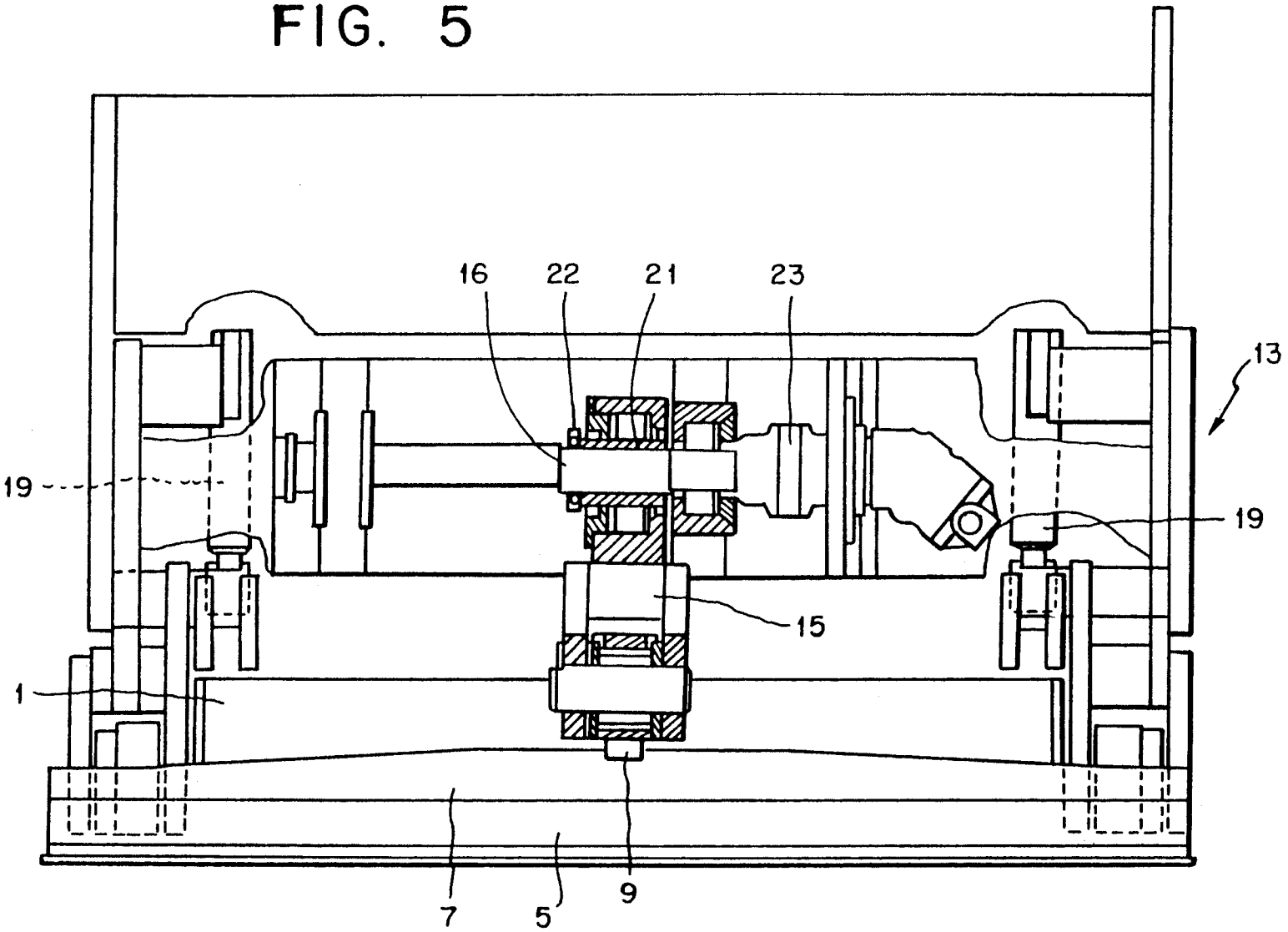

Embodiments which show additional characteristics of the invention are shown in the drawings. The drawings show:

FIG. 1: a segment of a cross-section of a compaction plank according to the invention, FIG. 2: a cross-section of a compaction plank according to the invention, FIG. 3: a cross-section of a second embodiment of a compaction plank according to the invention, FIG. 4: a cross-section of a third embodiment of a compaction plank according to the invention, and FIG. 5: a longitudinal section of the embodiment of a compaction plank according to the invention pursuant to FIG. 3, along the dotted line designated as V—V in FIG. 3.

FIG. 1 shows a segment of the front area of a compaction plank according to the invention, in cross-section.

Each compaction plank essentially consists of supporting components and a base plate. Accordingly, FIG. 1 shows a compaction plank 1 with a front base plate segment 2, which acts on laid road surface material 3 with its surface.

An arrow 4 indicates the direction of travel of the road finishing machine, in which the compaction plank is installed.

A preparatory rammer 5 is arranged in front of the front base plate segment 2, while a post-compaction rammer 6 is arranged after the front base plate segment 2. The two rammers 5, 6 each have bevels 5*a*, 6*a* at their front edges, with the bevel 5*a* of the preparatory rammer 5 not being as steep relative to the horizontal as the bevel 6*a* of the post-compaction rammer 6.

The two rammers 5, 6 are coupled together in terms of drive, via a two-arm lever 7, which is mounted to rotate around a point 8. The drive for the rammers, which has been left out for the sake of clarity, can attach at a bracket 9. The rammers are driven by oscillation, to move up and down, by the fact that the lever 7 tips back and forth around its fulcrum 8. The lever arm 7*a* to which the preliminary rammer 5 is attached is longer than the lever arm 7*b* to which the post-compaction rammer 6 is attached, so that the rammers 5, 6 exert different ramming forces.

The compaction plank 1 can pivot around a pivot axis 11, in the direction of the arrow 12, i.e. it can be lowered with its segment facing towards the post-compaction rammer 6 and therefore its angle can be adjusted.

FIG. 2 shows a cross-section of a compaction plank, with the representation containing the cross-section area of FIG. 1.

In FIG. 2, in which the same elements are designated with the same reference numbers as in FIG. 1, it is evident that the compaction plank consists of a main plank 13, which also has space 14 for adjustable planks which can extend laterally, in order to change the working width, with these also being an integral part of the compaction plank. The main plank 13 and the adjustable planks which can be arranged in the space 14 basically have the same structure.

Beyond the representation in FIG. 1, FIG. 2 indicates with broken lines 2*a* that the front base plate segment 2 can be adjusted in its angle, about the pivot axis 11. To adjust the angle of the compaction plank 1 and therefore of the front base plate segment 2, a spindle 17 is provided.

FIG. 2 also shows, with broken lines, how the rammers 5, 6 move around the fulcrum 8. The rammers 5, 6 are driven by a cam shaft 16, which is connected with the bracket 9 of the lever 7 of the rammers 5, 6 via a connecting rod 15.

Furthermore, it is evident in FIG. 2 that a rear base plate segment 18 is arranged after the post-compaction rammer 6. It is also evident that the post-compaction rammer 6 reaches down as far as the working surface of the rear base plate segment 18 which contracts the road surface material 3, in its up and down movement. The front base plate segment 2, i.e. 2*a* can also be adjusted in its angle so that its area facing the rear base plate segment 18 can be lowered to the level of the working surface of the rear base plate segment 18.

FIG. 3 shows a second embodiment of a compaction plank pursuant to FIG. 2.

In FIG. 3, an adjustable plank 14 is drawn in, in addition to the main plank 13.

The embodiment of the main plank 13 pursuant to FIG. 3 differs from the embodiment pursuant to FIG. 2 only in the changed structure of the adjustment device for the compaction plank 1, which no longer comprises a spindle 17 in this second embodiment, but essentially the working cylinder 19.

FIG. 4 shows a third embodiment of a compaction plank according to the invention, which again distinguishes itself from the previous embodiments by a changed form of the adjustment device.

In the embodiment shown, the adjustment device comprises an oil motor 20 with screw drive.

FIG. 5 shows a front view, in partial cross-section, of a main plank 13, specifically only one half of the longitudinal expanse of this main plank 13. At the left side of the representation is the center of the main plank 13, and here, the main plank 13 actually continues towards the left.

The main plank 13 shown could be any one of the main planks 13 shown in the previous figures, in principle. However, the main plank 13 of FIG. 3 was selected, and the cross-section selected in FIG. 5 runs approximately along the dotted line indicated as V—V in FIG. 3.

Similar elements are indicated with the same reference numbers as in FIG. 3.

In FIG. 5, it is evident that the compaction plank 1 can be adjusted via the working cylinders 19, without the pivot points of the preliminary rammers 5, 6 also being changed by this, since the compaction plank 1 is suspended separately from the preliminary rammers 5, 6 via the working cylinders 19.

It is furthermore evident from FIG. 5 how the cam shaft 16, the connecting rod 15 and the bracket 9 of the lever 7 are structured in cross-section.

In particular, it is evident that the shaft 16 has an eccentric structure in the area in which it is surrounded by the eye of the connecting rod 15, and that the eccentricity of a bushing 21, which surrounds the cam shaft 16 in this area, is added to this pre-determined eccentricity. This bushing 21 can be adjusted by rotating it coaxially around the cam shaft 16. The eccentricity set is fixed in place using the disk 22.

Depending on the position of the cam shaft 16 and the bushing 21 relative to one another, the eccentricities of the cam shaft 16 and the bushing 21 are added or subtracted, so that the cam formed by the cam shaft 16 and the bushing 21, which is surrounded by the eye of the connecting rod 15, can be changed in its eccentricity. A change in this eccentricity causes a change in the rammer stroke of the rammers 5, 6.

FIG. 5 also indicates a coupling 23, with which the cam shaft 16 is driven to rotate.

What is claimed is:

1. A compaction plank for a road finishing machine useful for installation and compaction of freshly laid road surface material, which is adjustable in its working width, comprising a main plank;

adjustable planks that are extendable laterally and removably connected alongside the main plank to extend the working width;

a base plate at the bottom of the apparatus which acts in the plane of the road surface material;

at least two strip-shaped, power-driven rammers comprising a preparatory rammer and a post compaction rammer;

said preparatory rammer arranged in front of the base plate in the direction of travel of the road finishing machine; and said post compaction rammer arranged in the middle of the base plate.

2. A compaction plank according to claim 1, further comprising means for driving the rammers in opposite cycles.

3. A compaction plank according to claim 1, further comprising drive means coupling the rammers together.

4. A compaction plank according to claim 2, furthe comprising a lever having two lever arms connecting the rammers with one another, with each of the rammers being connected with a different one of the two lever arms; and means for driving the lever to pivot around its fulcrum.

5. A compaction plank according to claim 1, wherien the rammers exert differetn ramming forces.

6. A compaction plank according to claim 4, wherein the lever arms of the lever which attach to the rammers are of different lengths.

7. A compaction plank according to claim 6, wherein the lever arm of the lever which attaches to the post-compaction rammer is the shorter lever arm.

8. A compaction plank according to claim 1, further comprising means for adjusting the rammer stroke of the rammers.

9. A compaction plank according to claim 1, further comprising means for adjusting the ramming frequency of the rammers.

10. A compaction plank according to claim 1, further comprising a rammer drive comprising a hydraulic working cylinder having a piston; and an exciter for oscillating excitation of the piston.

11. A compaction plant according to claim 1, wherein the rammer drive comprises a cam;

means for rotating the cam;

a connecting rod acting on the lever or the rammers.

12. A compaction plank according to claim 18, further comprising said cam having eccentricity; and means for adjusting the eccentricity of the cam of the rammer drive to alter the rammer stroke.

13. A compaction plank according to claim 1, further comprising a rear base plate segment which smooths the road surface material; and said rear base plate segment located after the post-compaction rammer.

14. A compaction plank according to claim 13, wherein the post-compaction rammer reaches down as far as the plane of the working surface of the rear base plate segment with its effective surface during the ramming movement.

15. A compaction plank according to claim 13, wherein the working surface of the front base plate segment is positioned higher than the working surface of the subsequent rear base plate segment, by the maximum rammer stroke of the post-compaction rammer.

16. A compaction plank according to claim 14, wherein the front base plate segment can be lowered, at least with one segment of its working surface, to the level of the working surface of the rear base plate segment, in order to reduce the height difference of the rear base plate segment.

17. A compaction plank according to claim 16, wherein the front bas plate segment has a longitudinal axis and has a pivot axis; and further comprising means for mounting and for lowering the front base segment to pivot around said pivot axis parallel to said longitudinal axis, which runs perpendicular to the direction of travel.

18. A compaction plank according to claim 16, further comprising means connecting the front base plate segment with an adjustment device for the metered lowering of the front base plate segment.

19. A compaction plank according to claim 17, wherein the radial distance of the front edge of the front base plate segment, pointing in the direction of travel of the road finishing machine, from the pivot axis, is less than the distance of the rear edge of the front base plate segment, pointing in the direction of the rear base plate segment.

20. A compaction plant according to claim 1, wherein the rammers have bevelled front edges.

21. A compaction plank according to claim 20, wherein the bevels of the preparatory rammer and the post-compaction rammer have different angles relative to a horizontal plane.

22. A compaction plank according to claim 21, wherein the bevel of the post-compaction rammer forms the greater angle with a horizontal plane than does the bevel of the preparatory rammer.

23. A compaction plank according to claim 1, wherein there is an interchangeable unit comprising the front base plate segment and the rammers.

* * * * *